US011592772B2

(12) United States Patent
Teshima

(10) Patent No.: US 11,592,772 B2
(45) Date of Patent: Feb. 28, 2023

(54) DENSITY ACQUISITION ASSISTANCE TECHNIQUE FOR IMAGE FORMING APPARATUS

(71) Applicant: CANON KABUSHIKI KAISHA, Tokyo (JP)

(72) Inventor: Eiichiro Teshima, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/727,204

(22) Filed: Apr. 22, 2022

(65) Prior Publication Data

US 2022/0365471 A1 Nov. 17, 2022

(30) Foreign Application Priority Data

May 14, 2021 (JP) ..... JP2021-082598

(51) Int. Cl.
*G03G 15/00* (2006.01)

(52) U.S. Cl.
CPC ..... *G03G 15/5025* (2013.01)

(58) Field of Classification Search
CPC ..... G03G 15/5025
See application file for complete search history.

(56) References Cited

U.S. PATENT DOCUMENTS

| | | | | |
|---|---|---|---|---|
| 6,111,664 | A | 8/2000 | Aoki et al. | |
| 8,014,688 | B2 * | 9/2011 | Yonekubo | G03G 15/5045 399/50 |
| 11,294,315 | B2 | 4/2022 | Kudo et al. | |

FOREIGN PATENT DOCUMENTS

| | | | |
|---|---|---|---|
| JP | H089158 | A | 1/1996 |
| JP | H1013675 | A | 1/1998 |
| JP | 2005119204 | A | 5/2005 |
| JP | 2014174231 | A | 9/2014 |
| JP | 2019020521 | A | 2/2019 |

* cited by examiner

*Primary Examiner* — Susan S Lee
(74) *Attorney, Agent, or Firm* — Rossi, Kimms & McDowell LLP

(57) ABSTRACT

An apparatus comprising a first control unit that executes density correction processing on image data and generates an image signal, an image forming unit that forms an image on a recording medium on the basis of the image signal, and a second control unit that controls the image forming unit. The first control unit includes a specifying unit that transmits specifying information relating to the density correction processing to the second control unit. The second control unit includes an acquisition unit that acquires a parameter relating to the image forming apparatus, and an estimation unit that estimates a plurality of image densities corresponding to tone levels identified by the specifying information transmitted from the first control unit on the basis of the parameter acquired by the acquisition unit and transmits the plurality of image densities to the first control unit.

20 Claims, 16 Drawing Sheets

| | | |
|---|---|---|
| ENVIRONMENTAL PARAMETER | TEMPERATURE | 23°C |
| | RELATIVE HUMIDITY | 50% |
| | ABSOLUTE MOISTURE AMOUNT | 10.3g/m$^3$ |
| | CARTRIDGE AMBIENT TEMPERATURE | 28°C |
| CONTROL PARAMETER | CHARGING VOLTAGE | -1000V |
| | DEVELOPMENT VOLTAGE | -500V |
| | PRIMARY TRANSFER VOLTAGE | 300V |
| STATE PARAMETER | REMAINING AMOUNT OF TONER | 40% |
| | DRUM REMAINING AMOUNT | 35% |

FIG. 7A

| | NORMAL PAPER MODE |
|---|---|
| TONE LEVEL 1 | 20h |
| TONE LEVEL 2 | 50h |
| TONE LEVEL 3 | 80h |
| TONE LEVEL 4 | B0h |
| | |
| TONE LEVEL NUMBER | 4 POINT |

FIG. 7B

| | GLOSS PAPER MODE |
|---|---|
| TONE LEVEL 1 | 40h |
| TONE LEVEL 2 | 60h |
| TONE LEVEL 3 | 80h |
| TONE LEVEL 4 | A0h |
| | |
| TONE LEVEL NUMBER | 4 POINT |

FIG. 7C

| | COLOR ADJUSTMENT MODE |
|---|---|
| TONE LEVEL 1 | 40h |
| TONE LEVEL 2 | 50h |
| TONE LEVEL 3 | 60h |
| TONE LEVEL 4 | 70h |
| TONE LEVEL 5 | 80h |
| TONE LEVEL 6 | 90h |
| TONE LEVEL 7 | A0h |
| TONE LEVEL 8 | B0h |
| | |
| TONE LEVEL NUMBER | 8 POINT |

FIG. 9A

| TONE LEVEL No | VIDEO CONTROLLER TYPE I |
|---|---|
| 1 | 20h |
| 2 | 50h |
| 3 | 80h |
| 4 | B0h |

FIG. 9B

| TONE LEVEL No | VIDEO CONTROLLER TYPE II |
|---|---|
| 1 | 40h |
| 2 | 60h |
| 3 | 80h |
| 4 | A0h |

FIG. 9C

| TONE LEVEL No | VIDEO CONTROLLER TYPE III |
|---|---|
| 1 | 40h |
| 2 | 50h |
| 3 | 60h |
| 4 | 70h |
| 5 | 80h |
| 6 | 90h |
| 7 | A0h |
| 8 | B0h |

FIG. 10A

| | |
|---|---|
| START VALUE | 20h |
| END VALUE | B0h |
| TONE LEVEL INTERVAL | 30h |

FIG. 10B

| | |
|---|---|
| START VALUE | 00h |
| END VALUE | FFh |
| TONE LEVEL INTERVAL | 01h |

FIG. 10C

| TONE LEVEL No. | TONE LEVEL |
|---|---|
| TONE LEVEL 1 | 20h |
| TONE LEVEL 2 | 50h |
| TONE LEVEL 3 | 80h |
| TONE LEVEL 4 | B0h |

FIG. 10D

| TONE LEVEL No. | TONE LEVEL |
|---|---|
| TONE LEVEL 1 | 00h |
| TONE LEVEL 2 | 00h |
| TONE LEVEL 3 | 02h |
| TONE LEVEL 4 | 03h |
| TONE LEVEL 5 | 04h |
| TONE LEVEL 6 | 05h |
| TONE LEVEL 7 | 06h |
| TONE LEVEL 8 | 07h |
| ⋮ | ⋮ |
| ⋮ | ⋮ |
| TONE LEVEL 250 | F9h |
| TONE LEVEL 251 | FAh |
| TONE LEVEL 252 | FBh |
| TONE LEVEL 253 | FCh |
| TONE LEVEL 254 | FDh |
| TONE LEVEL 255 | FEh |
| TONE LEVEL 256 | FFh |

FIG. 11

| VIDEO CONTROLLER TYPE INFORMATION | —— | 01 | 02 | 03 |
|---|---|---|---|---|
| CONTROLLER | DEFAULT TONE LEVEL | VIDEO CONTROLLER TYPE I | VIDEO CONTROLLER TYPE II | VIDEO CONTROLLER TYPE III |
| TONE LEVEL 1 | 30h | 20h | 40h | 30h |
| TONE LEVEL 2 | 58h | 50h | 60h | 50h |
| TONE LEVEL 3 | 80h | 80h | 80h | 60h |
| TONE LEVEL 4 | A8h | B0h | A0h | 70h |
| TONE LEVEL 5 | —— | —— | —— | 80h |
| TONE LEVEL 6 | —— | —— | —— | 90h |
| TONE LEVEL 7 | —— | —— | —— | A0h |
| TONE LEVEL 8 | —— | —— | —— | B0h |
| | | | | |
| TONE LEVEL TOTAL NUMBER | 4 POINT | 4 POINT | 4 POINT | 8 POINT |

DENSITY ACQUISITION ASSISTANCE TECHNIQUE FOR IMAGE FORMING APPARATUS

BACKGROUND OF THE INVENTION

Field of the Invention

The present invention relates to a density acquisition assistance technique for an image forming apparatus.

Description of the Related Art

Image density (tone characteristic) is used as a measure of image quality of an image formed by an image forming apparatus. In Japanese Patent Laid-Open No. 2014-174231, a first gradation correction including forming a patch image and correcting a gradation and a second gradation correction including not forming a patch image and correcting a gradation are proposed. In Japanese Patent Laid-Open No. 2019-020521, a method is proposed for obtaining a lookup table for a wide color gamut print mode using an image forming apparatus with a normal print mode and a wide color gamut print mode. Note that such a lookup table may also be referred to as a gradation correction table or a density correction table.

Here, in the image forming apparatus, there is a first controller that performs gradation correction using the lookup table and a second controller that controls the image forming engine. Depending on whether the image forming apparatus is in a control mode or an image processing mode, in a case where there are a plurality of lookup tables for gradation correction, the density (estimation result) required for each lookup table is different. In other words, a method is required for the second controller to appropriately assist the first controller to acquire the necessary density.

SUMMARY OF THE INVENTION

One aspect of the embodiments provides an image forming apparatus comprising a first control unit that executes density correction processing on image data and generates an image signal, an image forming unit that forms an image on a recording medium on the basis of the image signal, and a second control unit that controls the image forming unit. The first control unit includes a specifying unit that transmits specifying information relating to the density correction processing to the second control unit. The second control unit includes an acquisition unit that acquires a parameter relating to the image forming apparatus, and an estimation unit that estimates a plurality of image densities corresponding to tone levels identified by the specifying information transmitted from the first control unit on the basis of the parameter acquired by the acquisition unit and transmits the plurality of image densities to the first control unit.

Further features of the present invention will become apparent from the following description of exemplary embodiments (with reference to the attached drawings).

BRIEF DESCRIPTION OF THE DRAWINGS

FIGS. 7A to 7C are diagrams for describing a tone level specifying method.

FIGS. 9A to 9C are diagrams for describing a tone level specifying method.

FIGS. 10A to 10D are diagrams for describing a tone level specifying method.

FIG. 11 is a diagram for describing a tone level specifying method.

DESCRIPTION OF THE EMBODIMENTS

Figure 1:
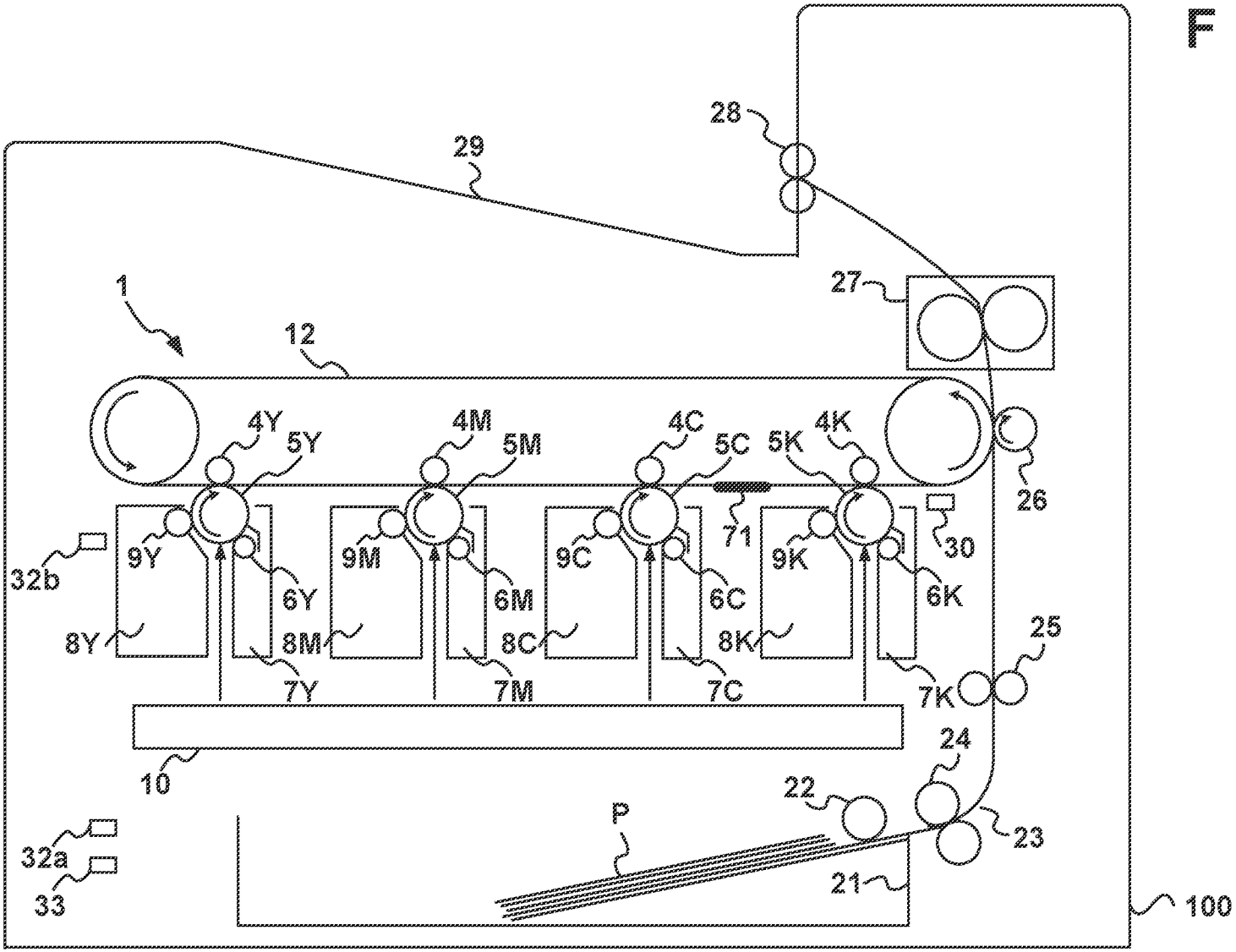
FIG. 1 is a diagram for describing an image forming apparatus.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

Example 1

Image Forming Apparatus

As illustrated in FIG. 1, an image forming apparatus 100 is a printer, a copy machine, or a multi-function peripheral that forms an image on a sheet P. In this example, the image forming method used is electrophotography. However, an inkjet method, a thermal-transfer method, or the like may be used as the image forming method. The characters Y (yellow), M (magenta), C (cyan), and K (black) indicating the toner color is attached to the end of the reference signs in FIG. 1. When describing an item in common between the four colors, the characters Y, M, C, K are omitted.

An image forming unit 1 superimposes YMCK toner images to form a full color image on the sheet P. A photosensitive drum 5 is an image carrier that carries an electrostatic latent image or a toner image and rotates. A charging device 6 uses a charging voltage to uniform charge the surface of the photosensitive drum 5. An exposure apparatus 10 exposes the photosensitive drum 5 to light in accordance with an image signal and forms an electrostatic latent image on the surface of the photosensitive drum 5. A developing roller 9 of a developing device 8 uses a development voltage to adhere the toner to the electrostatic latent image and forms a toner image. A primary transfer roller 4 uses a primary transfer voltage to transfer the toner image from the photosensitive drum 5 to an intermediate transfer belt 12. In this example, by transferring the YMCK toner images in order to the intermediate transfer belt 12, a full color image is formed. The intermediate transfer belt 12 conveys the toner image to a secondary transfer unit. The intermediate transfer belt 12 may be a conveyor belt that carries and conveys the sheet P. In this case, a toner image 71 is transferred from the photosensitive drum 5 to the sheet P. Note that the photosensitive drum 5, the charging device 6, and the developing device 8 may be integrally formed as a cartridge 7.

A sheet cassette 21 is capable of housing a plurality of the sheets P. A pickup roller 22 feeds one of the sheets P at a time from the sheet cassette 21 toward a conveyance path 23. A conveyance roller 24 conveys the sheet P along the conveyance path 23 and passes the sheet P to a registration roller 25. The registration roller 25 conveys the sheet P along the conveyance path 23 and passes the sheet P to a secondary transfer unit. A secondary transfer roller 26 provided in the secondary transfer unit transfers the toner image 71 conveyed by the intermediate transfer belt 12 onto the sheet P. Here, a secondary transfer voltage for promoting transfer of the toner image 71 is applied to the secondary transfer roller 26. A fixing device 27 fixes the toner image to the sheet P by applying heat and pressure to the toner image and the sheet P. A discharge roller 28 discharges the sheet P to a discharge tray 29.

A density sensor 30 measures the optical image density (hereinafter referred to simply as density) of the toner image 71 carried by the intermediate transfer belt 12. The density measurement result is used in density adjustment (for example, gradation correction) of the toner image. A temperature sensor 32*a* measures the temperature inside the image forming apparatus 100. A humidity sensor 33 measures the humidity inside the image forming apparatus 100. The temperature sensor 32*a* and the humidity sensor 33 are disposed close to one another and may be housed in a single housing, for example. A temperature sensor 32*b* measures the temperature around the cartridge 7. These temperatures and humidity levels are referred to as environmental parameters and are used to estimate the density of the toner image 71 without forming a test image.

Controller

Figure 2:
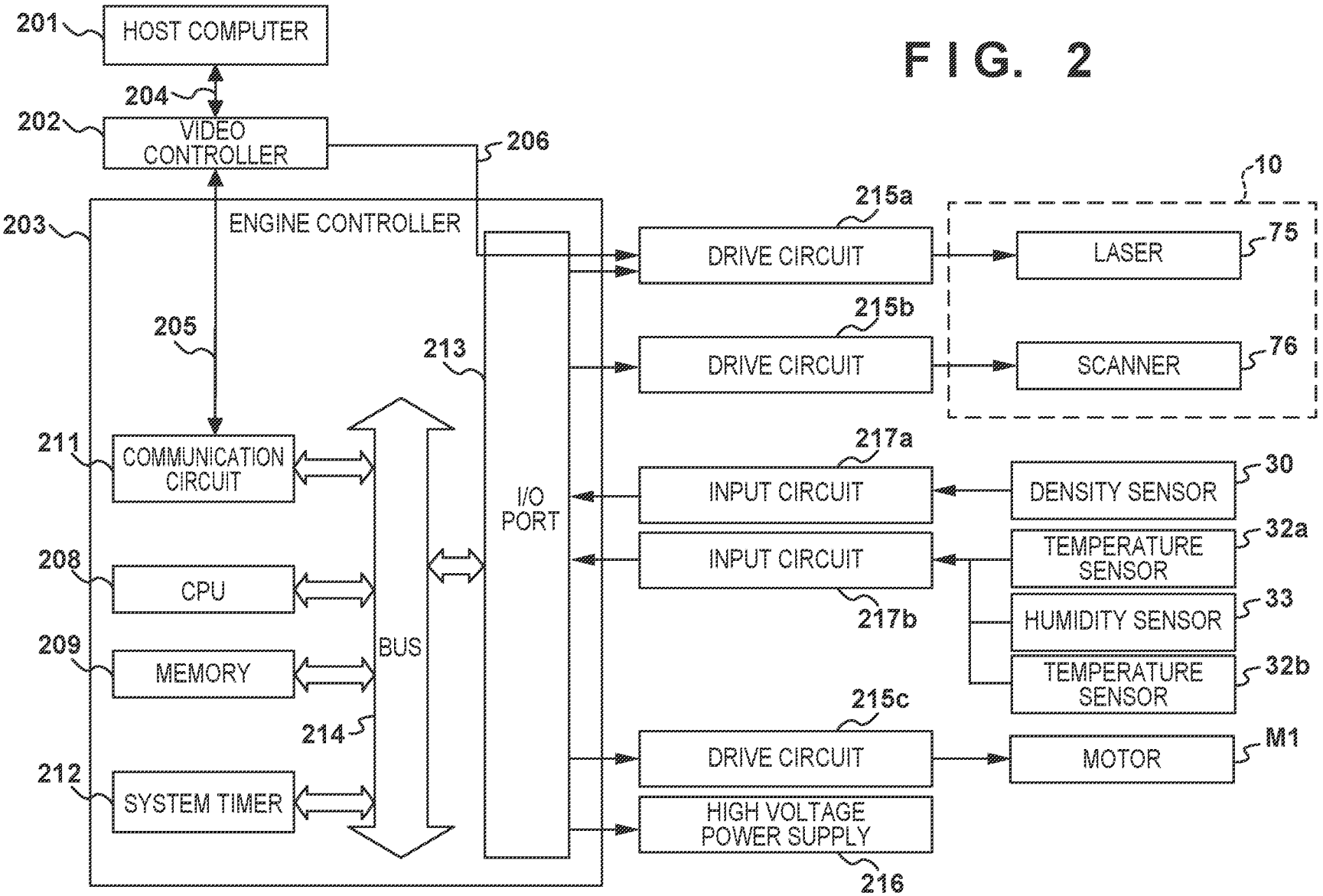
FIG. 2 is a diagram for describing a controller.

As illustrated in FIG. 2, the image forming apparatus 100 is provided with two control circuits or control boards, i.e., a video controller 202 and an engine controller 203. The video controller 202 is a controller that receives image data and print commands from a host computer 201 via a communication line 204. The video controller 202 may be referred to as a print controller or an image processing controller. The communication line 204, for example, may be a wired local area network (LAN) or a wireless LAN. The video controller 202 converts image data into an image signal of a predetermined format (video signal 206) and transmits this to the engine controller 203. The video controller 202 transmits a command corresponding to the command received from the host computer 201 to the engine controller 203.

The engine controller 203 mainly controls the image forming unit 1 (which may also be referred to as a printer engine). A communication circuit 211 of the engine controller 203 is a circuit that communicates with the video controller 202. A CPU 208 controls the image forming unit 1 in accordance with a control program stored in a memory 209. The CPU 208 is an example one or more of computer processors. The memory 209 may include one or more of a random-access memory (RAM), a read-only memory (ROM), a hard disk drive (HDD), a solid state drive (SSD), or the like. The CPU 208 is connected to drive circuits 215*a*, 215*b*, and 215*c*, input circuits 217*a*, 217*b*, and a high voltage power supply 216 via a bus 214 and an I/O port 213.

The drive circuit 215*a* drives a laser 75 of the exposure apparatus 10 in accordance with the video signal 206 input from the video controller 202 via the I/O port 213. The drive circuit 215*b* drives a scanner 76 that rotates a rotating polygon mirror in accordance with a command from the CPU 208. The scanner 76 includes a motor and the like. The drive circuit 215*c* drives a motor M1 in accordance with a command from the CPU 208. The motor M1 drives a plurality of rotary bodies forming the image forming unit 1. The rotary bodies are, for example, the pickup roller 22, the conveyance roller 24, the registration roller 25, the secondary transfer roller 26, the photosensitive drum 5, the intermediate transfer belt 12, and the like. The motor M1 may be a plurality of motors. The pickup roller 22 may be driven by a solenoid or the like.

The input circuit 217*a* includes a circuit that amplifies a detection signal output by the density sensor 30 that detects the density of the toner image 71, for example. The input circuit 217*a* reports the detection result of the density to the CPU 208 via the I/O port 213. The input circuit 217*b* includes a circuit that amplifies and outputs detection signals from the temperature sensors 32*a* and 32*b* and a detection signal from the humidity sensor 33. The input circuit 217*b* reports the detection result of the temperature and the humidity to the CPU 208 via the I/O port 213. Hereinafter, the density detection result and the density estimation result are written as density ΔE. The CPU 208 transmits the density ΔE to the video controller 202 via the communication circuit 211.

The high voltage power supply 216 is a power supply circuit that generates the high voltage of the charging voltage, the development voltage, the primary transfer voltage, the secondary transfer voltage, and the like in accordance with a command from the CPU 208. A system timer 212 is used by the CPU 208 to measure time and monitor the various control timings.

Video Controller Functions

Figure 3:
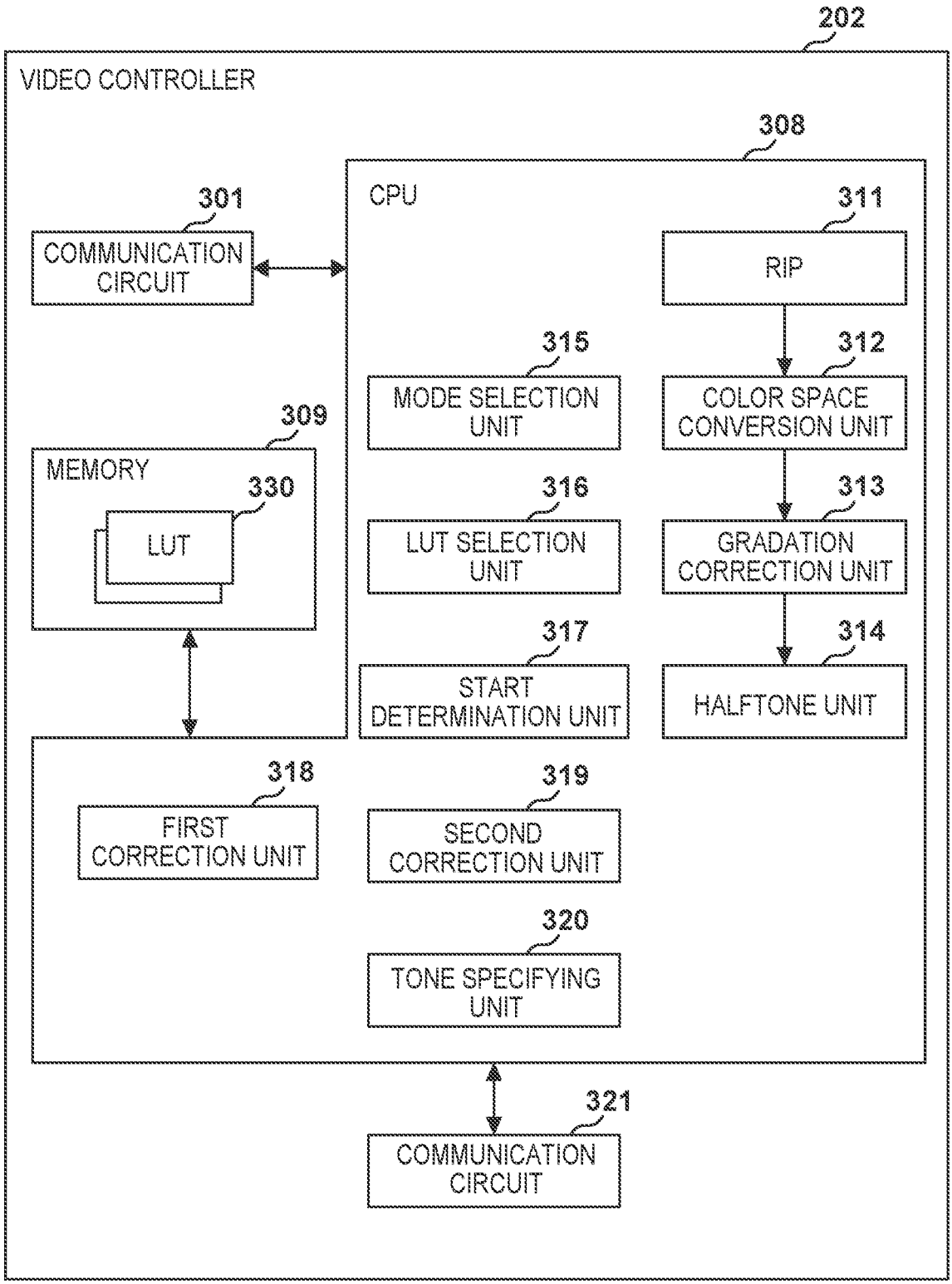
FIG. 3 is a diagram for describing a video controller.

FIG. 3 is a diagram illustrating the functions of the video controller 202. A CPU 308 communicates with the host computer 201 via a communication circuit 301. The CPU 308 is an example one or more of computer processors. The CPU 308 communicates with the engine controller 203 via a communication circuit 321. The CPU 308 implements a variety of functions by executing a control program stored in a ROM area of a memory 309. The memory 309 includes a storage apparatus such as ROM, RAM, or the like.

A raster image processor (RIP) 311 is a raster image processor that converts image data expressed by PostScript language or the like into image data of a bitmap format. A color space conversion unit 312 converts the color space (for example, RGB) of the image data input from the RIP 311 into the color space (for example, YMCK) of the toner. A gradation correction unit 313 uses a lookup table (LUT 330) stored in the memory 309 to correct the tone characteristic of the image data. In this manner, the tone characteristic of the original image and the tone characteristic of the image formed on the sheet P are made to match. The reproducibility of the gradation is maintained by the LUT 330 being corrected in accordance with the state of the image forming apparatus 100 (for example, the installation environment, the degree of wear of the components).

A mode selection unit 315 selects the operation mode of the image forming apparatus 100. The CPU 308, for example, includes a plurality of operation modes corresponding to the various types of the sheet P (plain paper, coated paper, thick paper, thin paper, recycled paper, and the like). The mode selection unit 315 selects the operation mode appropriate for the type of the sheet P. A LUT selection unit 316 selects the LUT 330 appropriate for the operation mode selected by the mode selection unit 315 and sets this for the gradation correction unit 313. The LUT 330 and the operation mode may be associated together and stored in the memory 209. A start determination unit 317 determines whether or not a start condition for starting the correction processing of the LUT 330 is satisfied. The start condition is stored in the memory 309 and, for example, is defined on the basis of one or more of the number of images to form, the environmental parameters (for example, temperature and humidity), the rest period of the image forming apparatus 100, or the like.

A first correction unit 318 corrects the LUT 330 on the basis of an actual measurement value acquired by the density sensor 30 detecting the density of a test image actually formed on the intermediate transfer belt 12. The first correction unit 318 outputs the video signal 206 of the test image to the engine controller 203 and updates or generates the LUT 330 on the basis of the actual measurement value of the density.

A second correction unit 319 corrects (updates or generates) the LUT 330 on the basis of an estimation value of the density acquired without forming a test image. The second correction unit 319 can save toner due to a test image not being formed. On the other hand, the first correction unit 318 can correct the LUT 330 with high accuracy due to an actual measurement value being used.

A tone specifying unit 320 specifies, to the engine controller 203, a tone level that helps identify a density estimation target. Accordingly, the CPU 308 is capable of specifying various tone levels to the engine controller 203. The plurality of LUT 330 include a LUT corrected on the basis of a small number of estimated densities and a LUT corrected on the basis of a larger number of estimated densities. Alternatively, there may be a plurality of LUTs with estimated densities (tone levels) of different positions even when the required number of estimated densities is the same. Thus, the estimation target may be different for each LUT. Here, by the video controller 202 specifying the estimation target corresponding to the LUT 330 to be corrected, the engine controller 203 can efficiently acquire the required estimation target.

Engine Controller Functions

Figure 4:
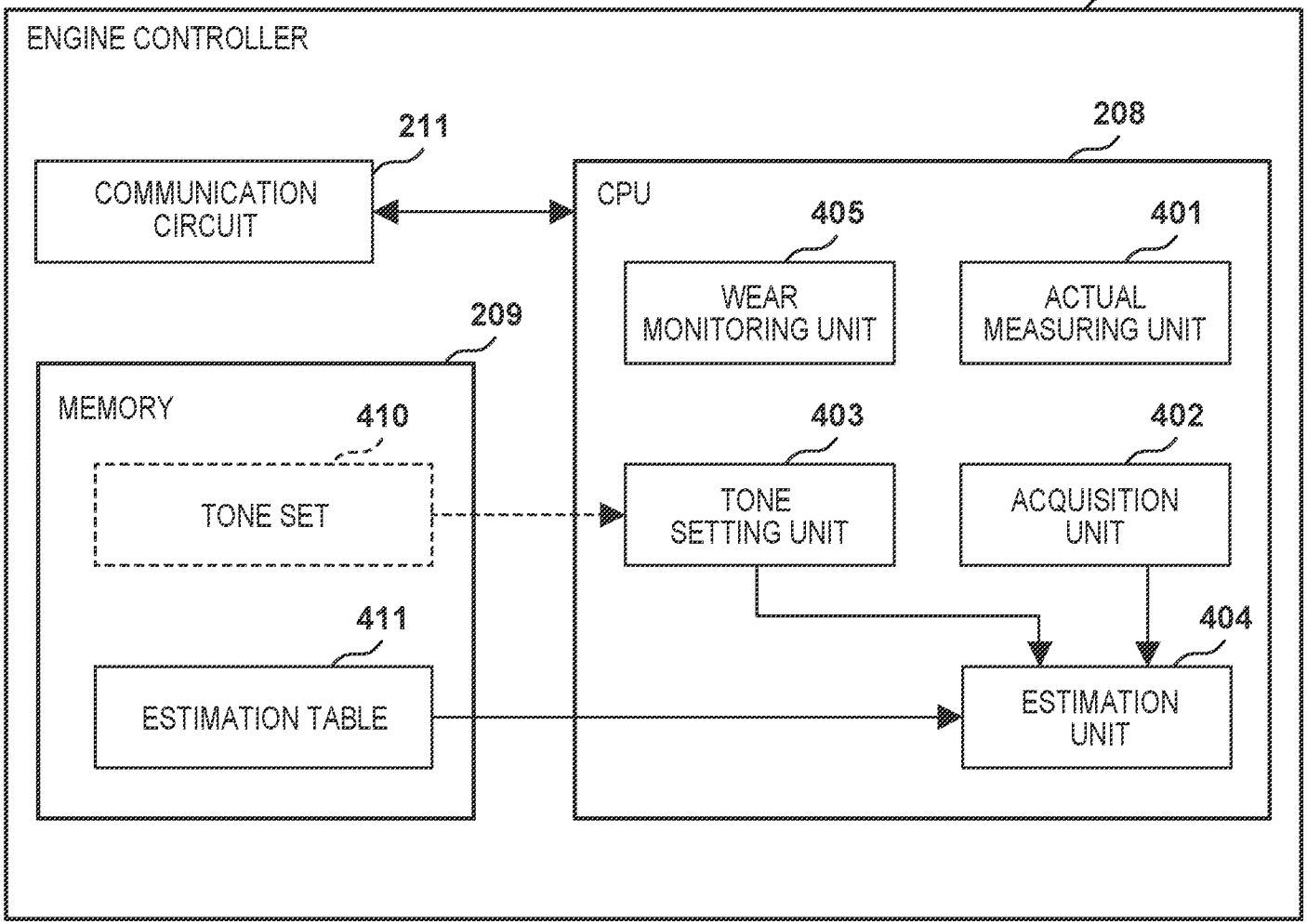
FIG. 4 is a diagram for describing an engine controller.

FIG. 4 is a diagram illustrating the functions implemented by the CPU 208 of the engine controller 203. An actual measuring unit 401 acquires the measurement result (detection result) of the test image from the density sensor 30, performs calculations, and reports this to the video controller 202 via the communication circuit 211. The test image may be referred to as a patch image or a pattern image. An acquisition unit 402 acquires a parameter that affects the image density of the toner image. Examples of such a parameter include an environmental parameter, a control parameter, and a state parameter, for example. The environmental parameter is, for example, the temperature detected by the temperature sensors 32*a* and 32*b*, the relative humidity detected by the humidity sensor 33, and the absolute moisture amount obtained from the detection result of the temperature sensor 32*a* and the detection result of the humidity sensor 33. The control parameter is, for example, the charging voltage, the development voltage, the primary transfer voltage, and the secondary transfer voltage. The state parameter is, for example, the amount of remaining toner contained in the developing device 8 and the amount of remaining surface layer of the photosensitive drum 5 (drum remaining amount). A wear monitoring unit 405 monitors the remaining amount of toner, the remaining amount of surface layer of the photosensitive drum 5, and the like. The wear monitoring unit 405 may, using a not-illustrated remaining amount sensor, acquire the remaining amount of toner, obtain the use amount of toner from the image data, acquire the remaining amount on the basis of the use amount, and the like. The wear monitoring unit 405 may acquire the remaining amount (thickness) of the surface layer on the basis of the rotation distance of the photosensitive drum 5. The rotation distance may be acquired on the basis of the time the photosensitive drum 5 takes to rotate and the rotational speed (circumferential speed) of the photosensitive drum 5.

A tone setting unit 403 sets the tone level for an estimation unit 404 on the basis of the specifying information received from the video controller 202. The estimation unit 404 estimates the image density on the basis of the tone level specified by the specifying information and the parameter acquired by the acquisition unit 402. For example, the estimation unit 404 may reference an estimation table 411 stored in the memory 209 and obtain a density corresponding to a set including a tone level and a parameter. The estimation table 411 holds the densities corresponding to a plurality of sets including a tone level and a parameter.

A tone set 410 is a set including a plurality of tone levels. The plurality of tone sets 410 are distinguished from one another by identification information. By the video controller 202 transmitting the identification information, the tone set 410 the tone setting unit 403 associates with the identification information can be read out from the memory 209. The tone setting unit 403 sets the plurality of tone levels included in the tone set 410 for the estimation unit 404. The estimation unit 404 transmits the image density estimation result to the video controller 202 via the communication circuit 211.

LUT Correction on the Basis of an Actual Measurement Value

The first correction unit 318 of the video controller 202 corrects, updates, or generates the LUT 330 on the basis of an actual measurement value of the density of the test image formed on the intermediate transfer belt 12. In this example, the LUT 330 is a lookup table indicating the relationship between tone levels and densities.

Figure 5:
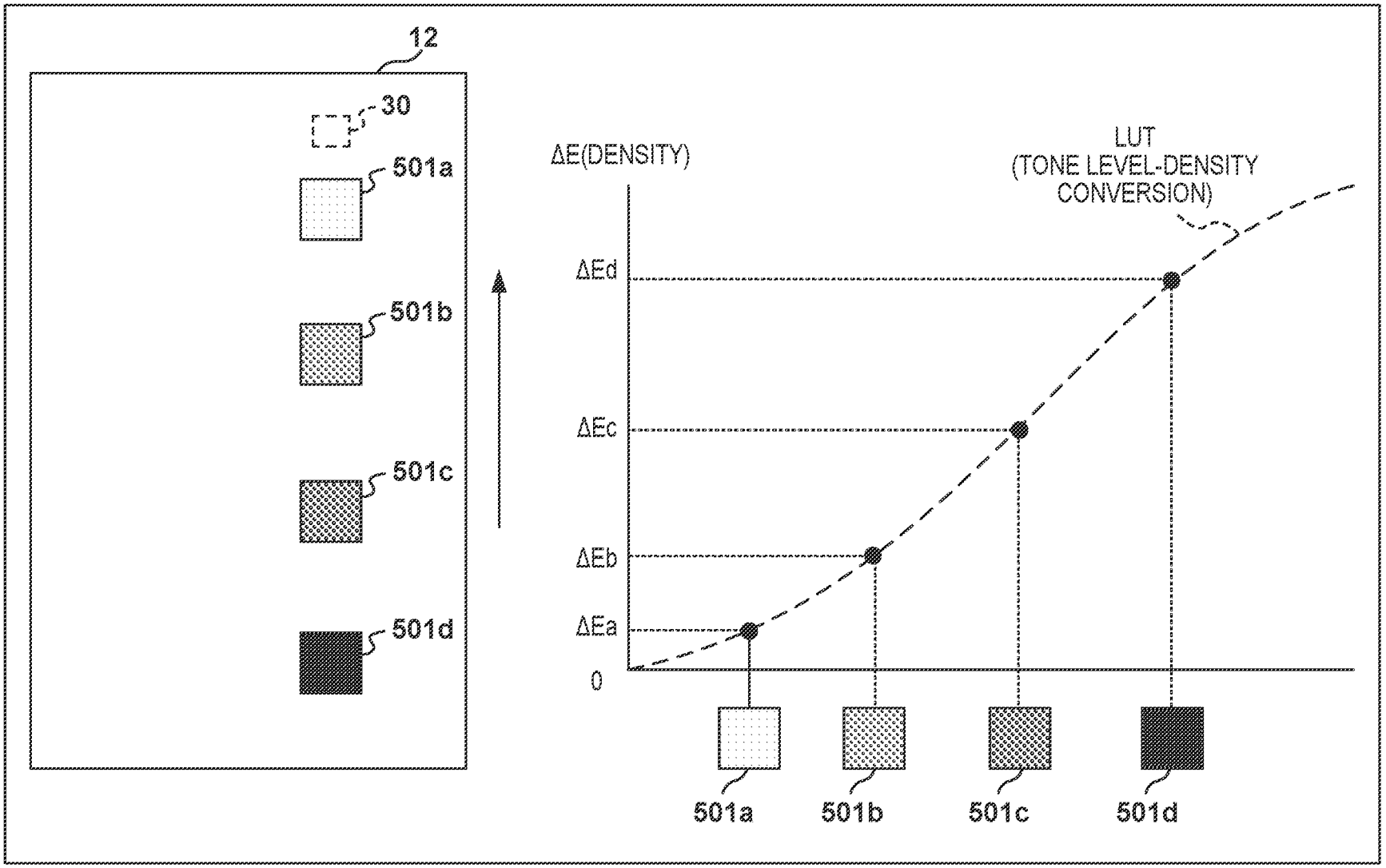
FIG. 5 is a diagram illustrating an example of the relationship between test images and densities.

FIG. 5 shows a diagram illustrating four test images 501*a* to 501*d* formed on the surface of the intermediate transfer belt 12. FIG. 5 also shows a diagram illustrating the relationship between the test images 501*a* to 501*d* and the density ΔE.

When the first correction unit 318 starts correction of the LUT 330, the first correction unit 318 transmits a command instructing the engine controller 203 to detect (measure) the test images 501*a* to 501*d*. The first correction unit 318 starts outputting the video signals 206 corresponding to the test images 501*a* to 501*d*.

When a command is received, the actual measuring unit 401 controls the image forming apparatus 100 and forms the test images 501*a* to 501*d* on the intermediate transfer belt 12. Also, the actual measuring unit 401 controls the density sensor 30 to read the test images 501*a* to 501*d* and acquire an actual measurement value (the density ΔE) of the densities of the test images 501*a* to 501*d*. Lastly, the actual measuring unit 401 transmits the densities ΔE of the test images 501*a* to 501*d* to the video controller 202.

The first correction unit 318 of the video controller 202 generates the LUT 330 on the basis of each one of the densities ΔE of the test images 501*a* to 501*d*. Here, because the first correction unit 318 generates the video signals 206 for forming the test images 501*a* to 501*d*, tone levels Ta to Td corresponding to the test images 501*a* to 501*d* are known. As illustrated in FIG. 5, the LUT 330 is generated by the first correction unit 318 mapping the tone levels Ta to Td and the densities ΔEa to ΔEd corresponding to the test images 501*a* to 501*d*. The LUT 330 is stored in the memory 309.

LUT Correction on the Basis of a Density Estimation Value

As described above, the second correction unit 319 corrects, generates, or updates the LUT 330 on the basis of the density (estimation value) estimated by the video controller 202 without forming a test image. Here, because a test image is not formed, the engine controller 203 is unable to identify which density corresponding to which tone level to estimate. Thus, the tone specifying unit 320 specifies or reports the tone level associated with the density which is the estimation target to the engine controller 203.

The tone setting unit 403 sets a specified N number of tone levels for the estimation unit 404. N is an integer of 1 or more. The estimation unit 404 estimates N number of densities corresponding to the specified N number of tone levels on the basis of the parameters acquired by the acquisition unit 402 and the wear monitoring unit 405. The estimation unit 404 transmits the specified N number of densities ΔE to the second correction unit 319 of the video controller 202. At this time, the estimation unit 404 may pair together the specified tone level T and the estimated density ΔE and transmit this to the video controller 202. This allows the second correction unit 319 to easily confirm the relationship between the tone level T and the estimated density ΔE. The second correction unit 319 corrects, updates, or generates the LUT 330 on the basis of the N number of tone levels and the N number of densities ΔE.

By correcting the LUT 330 using the estimation values of the densities in this manner, the amount of toner consumed is reduced. Also, down time is reduced. Down time is the period of time during which a user image cannot be formed due to a test image being formed. A user image is an image formed on the sheet P in response to an instruction from the host computer 201 (in other words, as desired by the user).

Figures 6A, 6B:
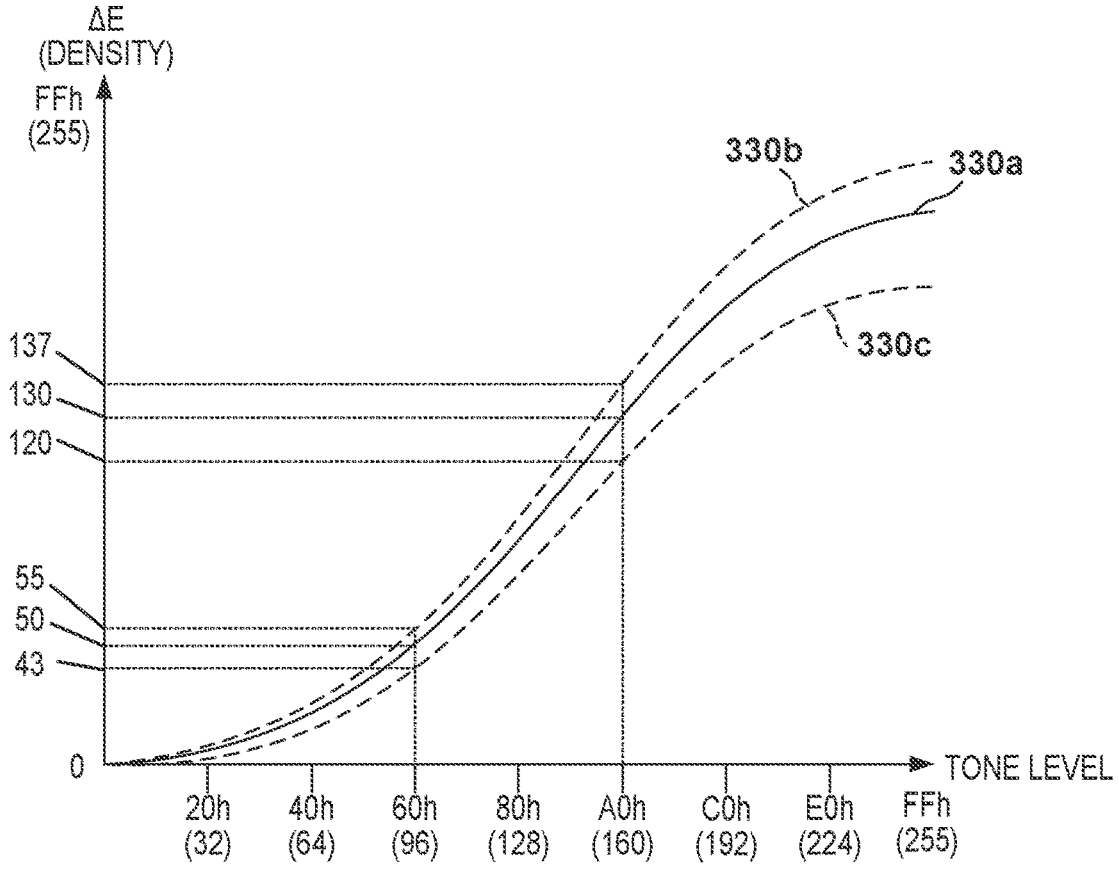
FIGS. 6A and 6B are diagrams for describing a density estimation method.

FIG. 6A is a diagram illustrating an example of parameters able to be used in density estimation. In this example, the environmental parameters are temperature (for example, 23 degrees C.), relative humidity (for example, 50%), and absolute moisture amount (for example, 10.3 g/$m^3$). $m^3$ indicates cubic meters. The control parameters are charging voltage (for example, −1000 V), development voltage (for example, −500 V), and primary transfer voltage (for example, 300 V). The state parameters are remaining amount of toner (for example, 40%) and drum remaining amount (for example, 35%). The estimation unit 404 uses these parameters, the tone levels, and the estimation table 411 to estimate the densities ΔE.

FIG. 6B is a diagram illustrating the LUT 330 generated on the basis of the estimated densities ΔE and the specified tone levels T. The curve of the LUT 330 changes depending on the parameters indicated in FIG. 6A. A LUT 330*a* is obtained in the case of the parameters indicated in FIG. 6A. A LUT 330*b* is obtained when, of the parameters indicated in FIG. 6A, the environmental parameters are changed to a low temperature and low humidity. A LUT 330*c* is obtained when, of the parameters indicated in FIG. 6A, the charging voltage is changed in the negative direction (for example, charging voltage=−1200 V).

As described above, the LUT 330 is generated by the second correction unit 319, but may be generated in the engine controller 203. The CPU 208 generates the LUT 330 on the basis of the specified N number of tone levels and the estimated N number of densities ΔE and transmits the LUT 330 to the video controller 202.

According to the LUT 330*a* of FIG. 6B, in a case where the tone level is 60h, the density ΔE is 50 (32h). According to the LUT 330*b*, in a case where the tone level is 60h, the density ΔE is 55 (37h). According to the LUT 330*c*, in a case where the tone level is 60h, the density ΔE is 43 (2Bh).

Also, according to the LUT 330*a*, in a case where the tone level is A0h, the density ΔE is 130 (82h). According to the LUT 330*b*, in a case where the tone level is A0h, the density ΔE is 137 (89h). According to the LUT 330*c*, in a case where the tone level is A0h, the density ΔE is 120 (78h). In this manner, even if the tone level is the same, if the parameter is different, the density ΔE is different.

Method of Specifying Tone Level

In the case of stabilizing the densities across a wide range of gradations, the video controller 202 specifies a plurality of tone levels across a wide range. In order to reduce the specified number of tone levels, the intervals between the specified plurality of tone levels may be not wide. On the other hand, in the case of stabilizing the density of halftones in the image, the video controller 202 specifies a plurality of tone levels in a small range called a halftone area. In other words, the interval between the specified tone levels is made narrower In this manner, the position and total number of tone levels required to generate the LUT 330 is different for each operation mode of the video controller 202. Thus, the video controller 202 specifies, to the engine controller 203, the tone level corresponding to the density ΔE which is the estimation target.

FIG. 7A is a diagram illustrating the tone level required to generate the LUT 330 for the mode for printing an image on plain paper and a total number N of tone levels. The total number N is 4 points. The tone level 1 is 20h. The tone level 2 is 50h. The tone level 3 is 80h. The tone level 4 is B0h. These four tone levels help in stabilizing the density with regard to the gradation of a relatively wide area.

FIG. 7B is a diagram illustrating the tone level required to generate the LUT 330 for the mode for printing an image on gloss paper and a total number N of tone levels. The total number N is 4 points. The tone level 1 is 40h. The tone level 2 is 60h. The tone level 3 is 80h. The tone level 4 is A0h. These four tone levels help in stabilizing the density of the halftone area.

Comparing FIG. 7B and FIG. 7A shows that the minimum value and the maximum value of the specified tone level and the interval between two adjacent tone levels are different. In FIG. 7A, because the difference between the minimum value and the maximum value of the tone level is large, the tone level specified area is wide. The interval between two adjacent tone levels is 30h, which is relatively wide. In FIG. 7B, because the difference between the minimum value and the maximum value of the tone level is small, the tone level specified area is narrow. The interval between two adjacent tone levels is 20h, which is relatively narrow.

FIG. 7C is a diagram illustrating the tone levels required by the LUT 330 for a mode for the user to give detailed color adjust instructions and the total number N of tone levels. The total number N is 8 points. The tone level 1 is 40h. The tone level 2 is 50h. The tone level 3 is 60h. The tone level 4 is 70h. The tone level 5 is 80h. The tone level 6 is 90h. The tone level 7 is A0h. The tone level 8 is B0h. By specifying multiple tone levels in a wide area with narrow intervals (10h in this example) in this manner, the image density in a full-tone area is stabilized.

The tone level used in LUT correction on the basis of the actual measurement value and the tone level used in LUT correction on the basis of the estimation value may match or not match. Also, the total number N of tone levels and the N number of tone levels may both is specified or only the N number of tone levels may be specified.

Flowchart

Figure 8:
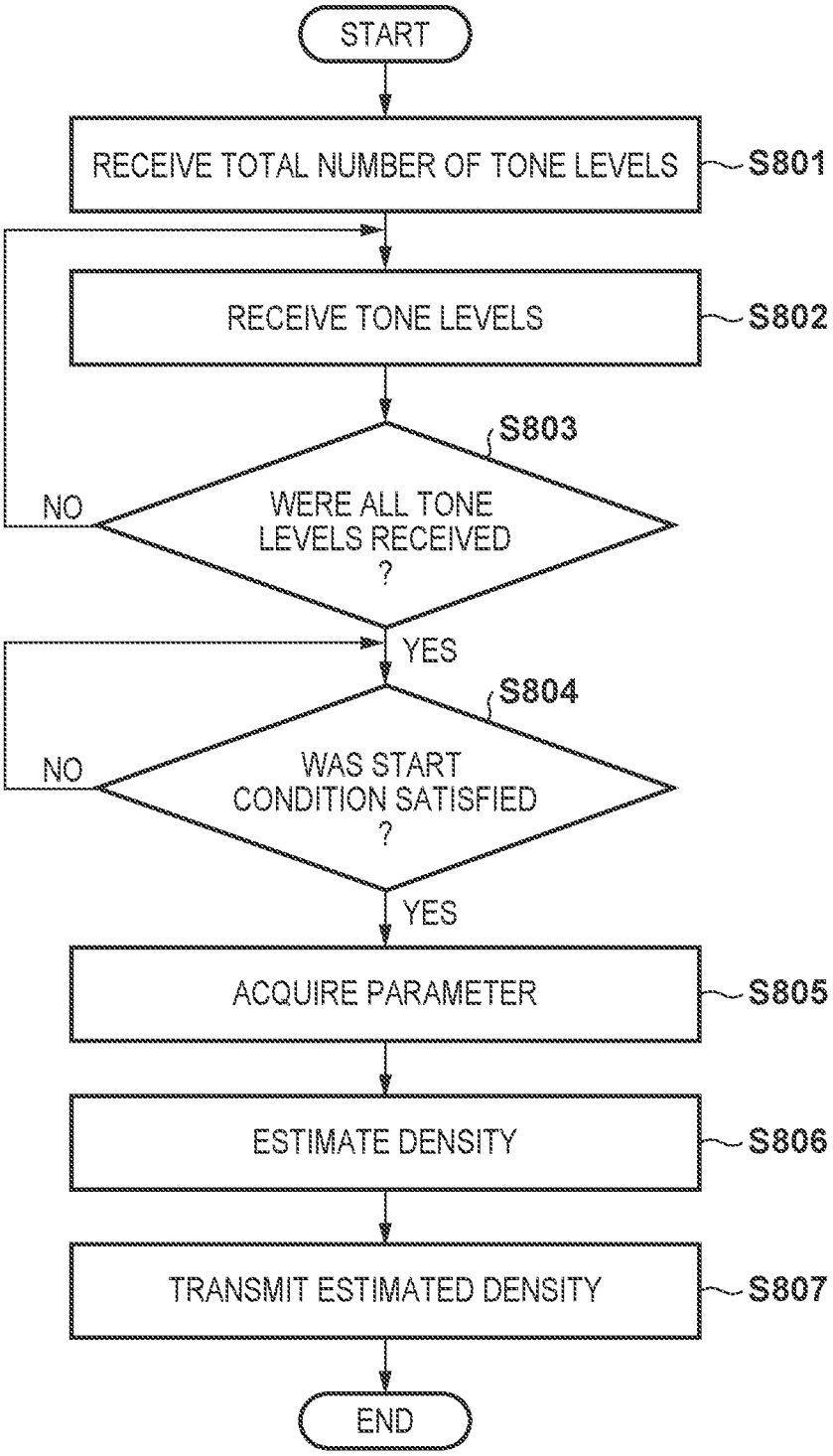
FIG. 8 is a flowchart illustrating a density estimation method.

FIG. 8 is a flowchart illustrating a method of estimating the density executed by the CPU 208 of the engine controller 203. When power is supplied from a commercial power supply to the image forming apparatus 100 and the image forming apparatus 100 is activated, the CPU 208 executes the following processing in accordance with the control program.

In step S801, the CPU 208 (the tone setting unit 403) receives the total number N of tone levels from the video controller 202.

In step S802, the CPU 208 (the tone setting unit 403) receives the tone levels from the video controller 202. Note that the CPU 208 stores the received total number N and the tone levels in the RAM of the memory 209.

In step S803, the CPU 208 (the tone setting unit 403) determines whether or not all of the tone levels have been received. For example, whether or not all of the tone levels have been received may be determined by the tone setting unit 403 comparing the received number (count number) of tone levels and the total number N. In a case where all of the tone levels have not been received, the CPU 208 returns to step S802 and receives the next tone level. In a case where all of the tone levels have been received, the CPU 208 proceeds to step S804.

In step S804, the CPU 208 determines whether or not the start condition of the density estimation has been satisfied. The start condition may be that, for example, a predetermined amount of time, a predetermined number of images formed, or that an amount of fluctuation in the environmental parameter has exceeded a threshold. Also, the start condition may be that a start command has been received from the video controller 202. In this case, the CPU 208 may report the information required to perform determination of the start condition, such as the number of images formed or the environmental parameters, to the video controller 202. Accordingly, the start determination unit 317 of the video controller 202 determines whether or not the start condition has been satisfied and transmits a command based on the determination result. In a case where the start condition is satisfied, the CPU 208 proceeds to step S805.

In step S805, the CPU 208 (the acquisition unit 402) acquires the parameter required to estimate the density.

In step S806, the CPU 208 (the estimation unit 404) uses the specified tone level and the parameters to estimate the density ΔE corresponding to the specified tone level.

In step S807, the CPU 208 (the estimation unit 404) transmits the estimated density ΔE corresponding to the specified tone level to the video controller 202.

In the example of FIG. 8, the total number N of tone levels and the tone levels are received. However, as illustrated in FIGS. 9A to 9C, a tone level number and a tone level may be paired together and received. Alternatively, as illustrated in FIGS. 10A and 10B, the start value of the tone level (minimum value from among the specified tone levels), the end value (maximum value from among the specified tone levels) and the tone level interval may be specified.

The tone setting unit 403 is capable of identifying the four tone levels indicated in FIG. 10C on the basis of the start value (20h), the end value (B0h), and the tone level interval (30h) indicated in FIG. 10A. In a similar manner, the tone setting unit 403 is capable of identifying the 256 tone levels indicated in FIG. 10D on the basis of the start value (00h), the end value (FFh), and the tone level interval (01h) indicated in FIG. 10B.

In the example of FIG. 8, the tone level is specified just after the video controller 202 is activated, but this is merely an example. The video controller 202 may specify the tone level when the engine controller 203 executes density estimation.

Example 2

A plurality of image forming apparatuses sold as different products on the market may be installed with a common (the same) engine controller 203. Also, these image forming apparatuses may each be installed with a different video controller 202. Some video controllers 202 may impart the image forming apparatus 100 with many functions, while other may impart fewer functions. For example, on the market, there are single function printers (SFP) with only a print function and multifunction printers (MFP) with a print function and an image reading function. The video controller 202 for an SFP and the video controller 202 for an MFP are then understandably different. These different video controllers 202 use different image density processes, and thus the method of generating the LUT 330 is also different. If the image density process is different, what is an appropriate LUT 330 is also different. Thus, the video controller 202 needs to specify to the engine controller 203 the tone level required to generate the appropriate LUT 330.

In Example 2, the tone levels able to the specified by the video controller 202 are stored in advance in the engine controller 203 for each type of the video controller 202. The tone setting unit 403 of the engine controller 203 acquires the tone level corresponding to the type information from the memory 209 on the basis of the type information of the video controller 202 transmitted from the video controller 202. Note that in some cases the video controller 202 may not transmit the type information. In such cases, the tone setting unit 403 uses the default tone level stored in the memory 209.

FIG. 11 is a diagram illustrating a tone level set held in the memory 209 and 309. In a case where the type information (type code) is 01, the type of the video controller 202 is I and four tone levels (20h, 50h, 80h, and B0h) are specified. In a case where the type information is 02, the type of the video controller 202 is II and four tone levels (40h, 60h, 80h, and A0h) are specified. In a case where the type information is 03, the type of the video controller 202 is III and eight tone levels (40h, 50h, 60h, 70h, 80h, 90h, A0h, and B0h) are specified. By the CPU 308 (the tone specifying unit 320) transmitting the type information to the CPU 208 (the tone setting unit 403), the CPU 208 (the tone setting unit 403) can read out the tone level corresponding to the type information from the memory 209.

Figure 12:
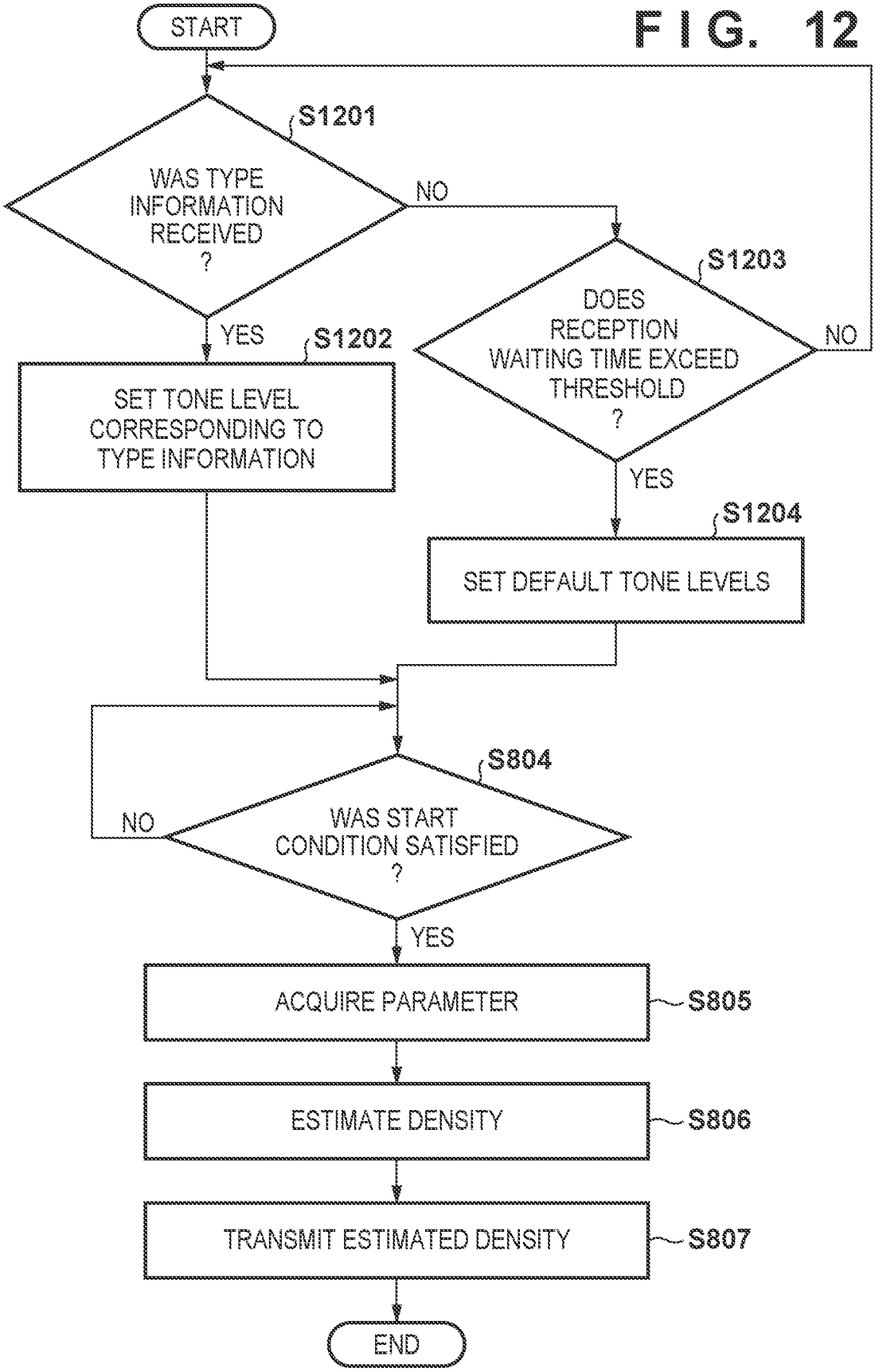
FIG. 12 is a flowchart illustrating a density estimation method.

FIG. 12 is a flowchart illustrating density estimation executed by the CPU 208 of the engine controller 203. The description of items in common with the items described using FIG. 8 will be omitted. Specifically, steps S804 to S807 executed after steps S1202 and S1204 are as described in Example 1.

In step S1201, the CPU 208 (the tone setting unit 403) determines whether or not the type information has been received from the video controller 202. In a case where the type information has been received, the CPU 208 proceeds to step S1202.

In step S1202, the CPU 208 (the tone setting unit 403) acquires the tone level corresponding to the type information from the memory 209 and sets this for the estimation unit 404. On the other hand, in a case where the type information is not received in step S1201, the CPU 208 proceeds to step S1203.

In step S1203, the CPU 208 (the tone setting unit 403) determines whether or not the amount of waiting time measured by the system timer 212 has exceeded a threshold. In a case where the amount of waiting time has not exceeded the threshold, the CPU 208 returns to step S1201. In a case where the amount of waiting time has exceeded the threshold, the CPU 208 proceeds to step S1204.

In step S1204, the CPU 208 (the tone setting unit 403) acquires the default tone level from the memory 209 and sets this for the estimation unit 404.

In this manner, a tone level set including a plurality of tone levels is identified on the basis of specifying information (type information) transmitted from the video controller 202. In Example 2, a tone level set is identified on the basis of the type information of the video controller 202, but this is merely an example. For example, in a case where the video controller 202 includes a plurality of image density processes, identification information of the tone level set may be transmitted instead of the type information. In this manner, appropriate tone levels can be set for each image density process. Note that for the identification information, it is sufficient that the tone level set be able to be identified, and the identification information may be identification information of an image density process associated with a tone level set.

Example 3

In Examples 1 and 2, the engine controller 203 identifies which density to estimate for a tone level on the basis of the specifying information transmitted from the video controller 202. However, it is not required that the video controller 202 transmits the specifying information. For example, the engine controller 203 may estimate two or more densities in advance without using the specifying information and transmit this to the video controller 202. The video controller 202 may select and use the density actually required from among the two or more densities received from the engine controller 203.

Figure 13:
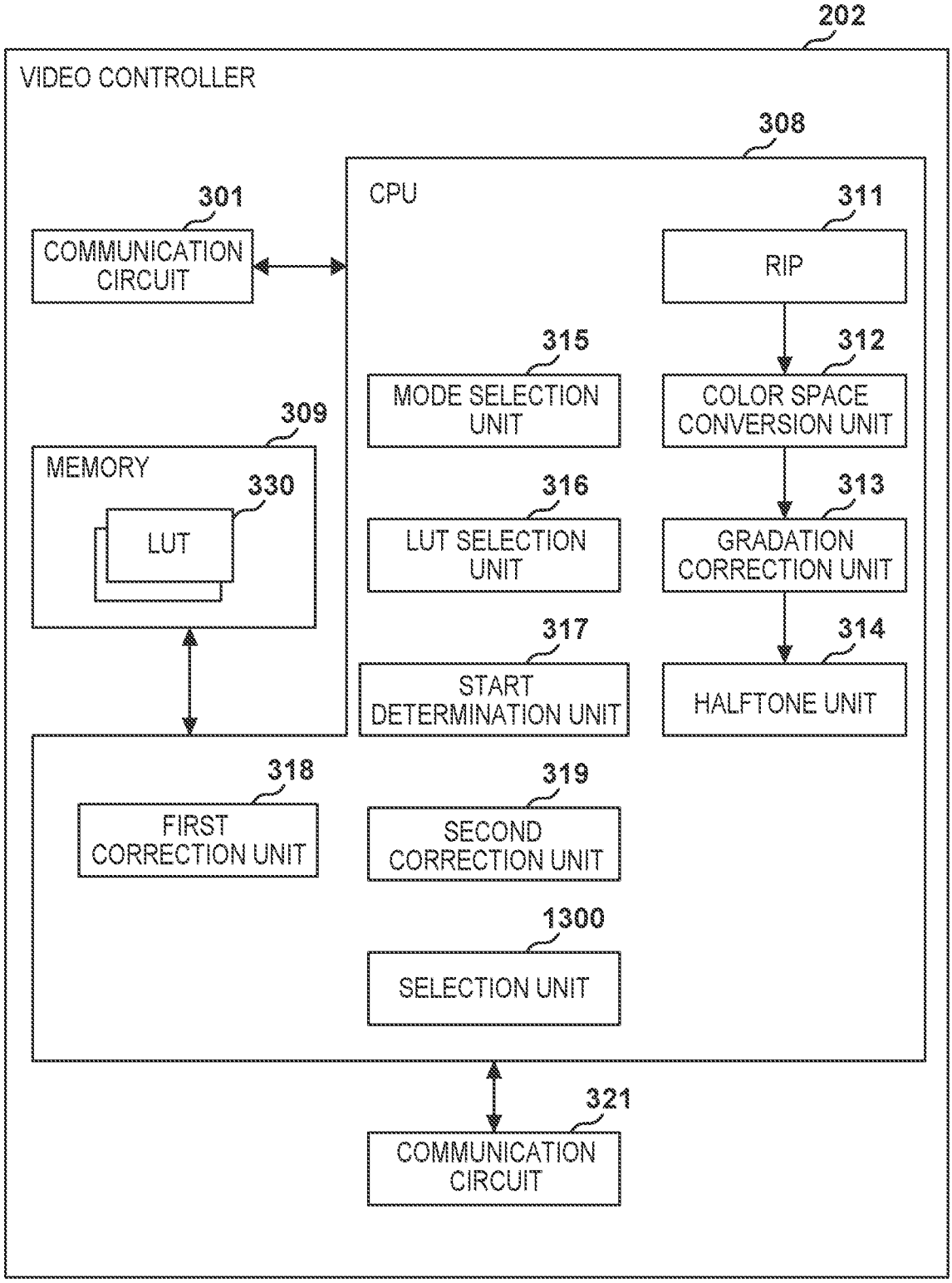
FIG. 13 is a diagram for describing a video controller.
Figure 14:
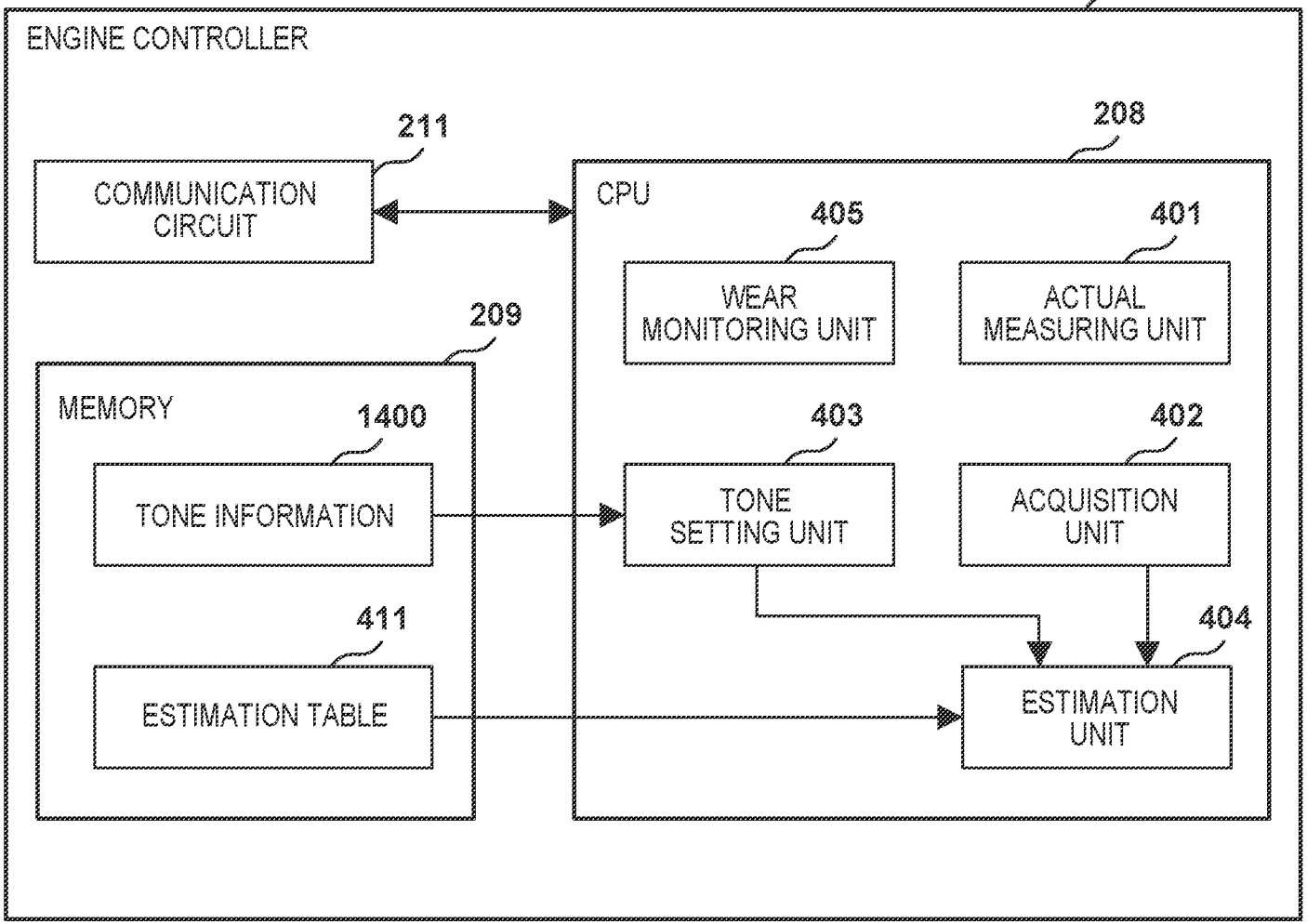
FIG. 14 is a diagram for describing an engine controller.

FIG. 13 is a diagram illustrating the video controller 202 of Example 3. FIG. 14 is a diagram illustrating the engine controller 203 of Example 3. Components that are the same as that described in Examples 1 and 2 are given the same reference sign, and the description thereof is omitted.

As illustrated in FIG. 13, a video controller 308 includes a selection unit 1300. The selection unit 1300 selects M number of densities to be actually used by the second correction unit 319 from among N number of densities estimated by the engine controller 203 and provides M number of densities to the second correction unit 319. Here, N and M are integers, and N is equal to or greater than M. In a case where N is less than M, at least two of the N number of densities may be used to acquire M−N number of densities by the CPU 308 using an interpolation calculation.

As illustrated in FIG. 14, tone information 1400 is stored in the memory 209. The tone information 1400 is N number of densities considered to be required by the second correction unit 319, for example, and holds N number of tone levels corresponding to N number of densities. The tone setting unit 403 reads out the tone information 1400 from the memory 209, acquires N number of tone levels included in the tone information 1400, and sets this for the estimation unit 404. As described above, the estimation unit 404 estimates N number of densities corresponding to N number of tone levels on the basis of the parameters acquired by the acquisition unit 402. The estimation unit 404 transmits N number of densities to the video controller 202 via the communication circuit 211. Here, the estimation unit 404 may pair together the estimated density and the identification information indicating the tone level and transmit this to the video controller 202. In this manner, the video controller 202 is able to easily identify which estimated density corresponds to which tone level. In this manner, in Example 3, the video controller 202 is able to acquire the N number of densities required by the second correction unit 319 without using specifying information.

Example 4

In Examples 1 to 3, the engine controller 203 estimates the image density. However, the estimation unit 404 may be provided in the video controller 202. In this case, there is no need to transmit the specifying information from the video controller 202 to the engine controller 203.

Figure 15:
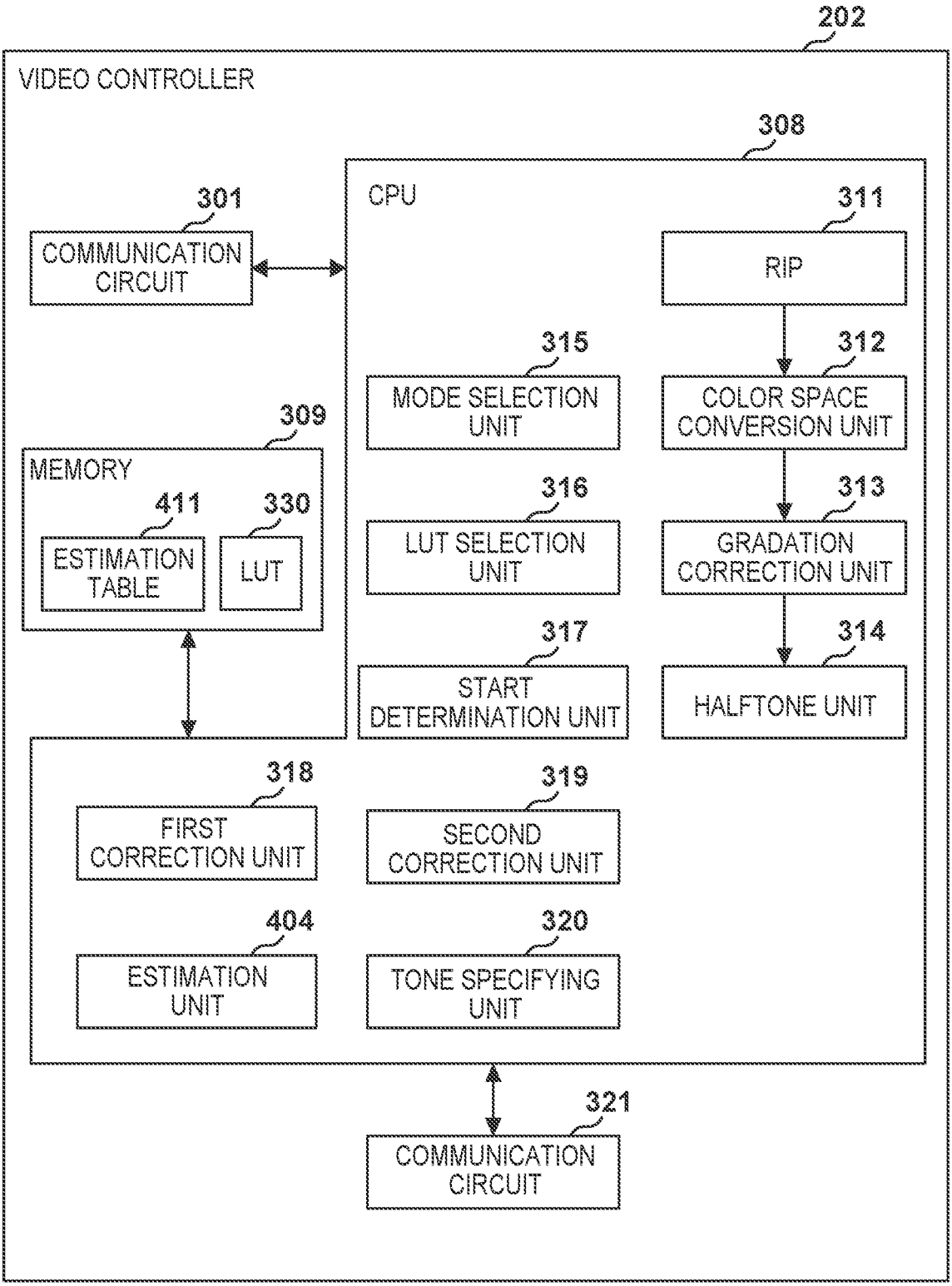
FIG. 15 is a diagram for describing a video controller.
Figure 16:
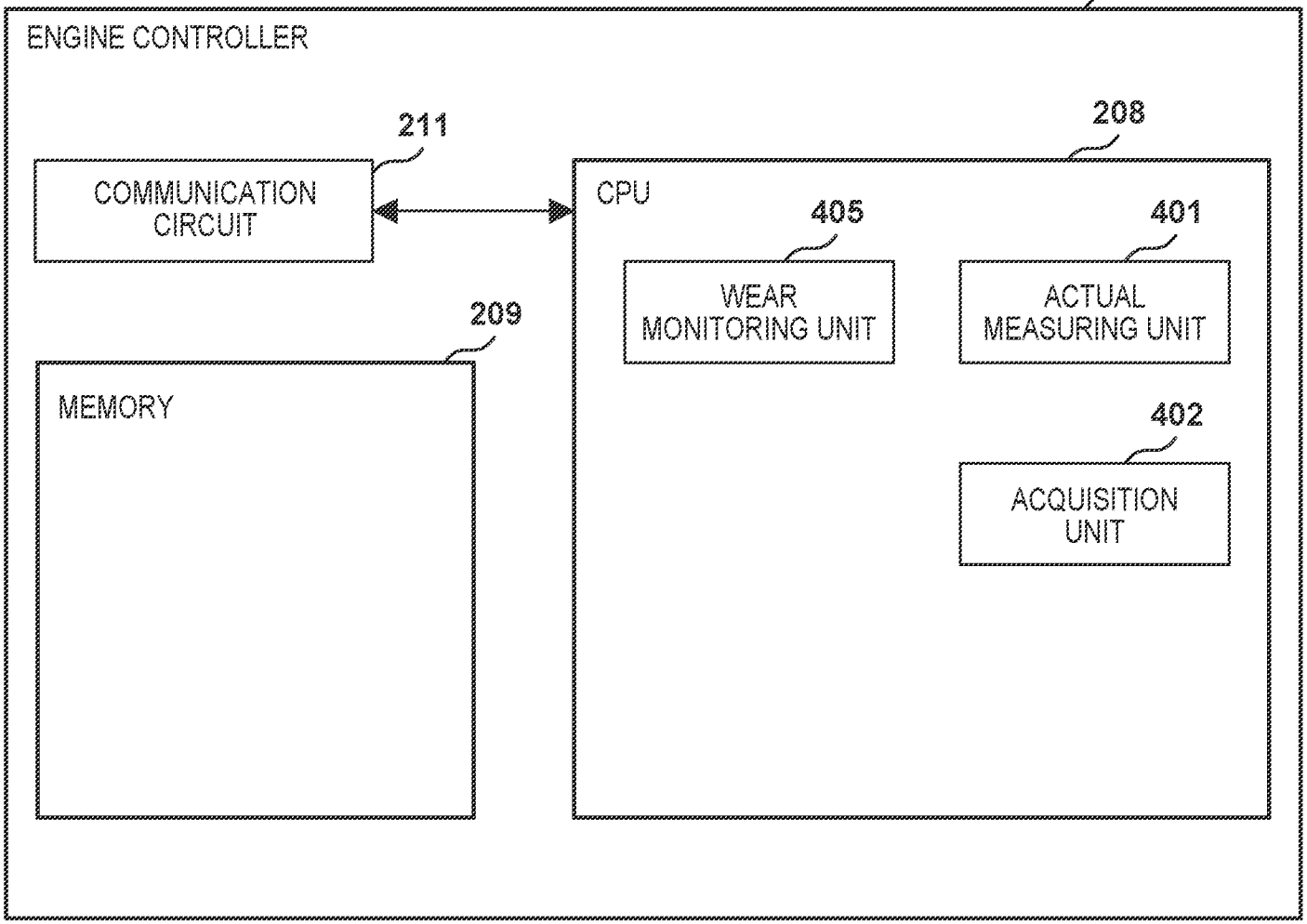
FIG. 16 is a diagram for describing an engine controller.

FIG. 15 is a diagram illustrating the video controller 202 of Example 4. FIG. 16 is a diagram illustrating the engine controller 203 of Example 4. Components that are the same as that described in Examples 1 and 2 are given the same reference sign, and the description thereof is omitted.

As illustrated in FIG. 15, the CPU 308 of the video controller 202 includes the estimation unit 404. The memory 309 includes the estimation table 411. The estimation unit 404 receives the parameter from the engine controller 203 via the communication circuit 321. The estimation unit 404 estimates the image density corresponding to the tone level specified by the tone specifying unit 320 on the basis of the received parameter. The estimation unit 404 passes the image density which is the estimation result to the second correction unit 319.

As illustrated in FIG. 16, the CPU 208 of the engine controller 203 includes the acquisition unit 402. The acquisition unit 402 transmits the parameter which is the acquisition result to the video controller 202 via the communication circuit 211. As described above, the parameter may be a parameter relating to the image forming apparatus that may directly or indirectly affect the image density of the toner image. In this manner, in Example 4, the image density can be estimated without transmitting specifying information from the video controller 202 to the engine controller 203.

Supplement

Perspective 1

The video controller 202 (first control circuit board) is an example of a first control unit that applies density correction processing to image data and generates an image signal. The image forming unit 1 is an example of an image forming unit that forms an image on a recording medium on the basis of the image signal. The engine controller 203 (second control circuit board) is an example of a second control unit that controls the image forming unit. The tone specifying unit 320 is an example of a specifying unit that specifies, to the second control unit, a plurality of image densities corresponding to estimation targets for the estimation unit. The tone specifying unit 320 functions as a specifying unit that transmits specifying information that can be used to identify a tone level to the second control unit. The tone specifying unit 320 may function as a specifying unit that transmits specifying information relating to the density correction processing to the second control unit. The CPU 208 and the acquisition unit 402 function as an acquisition unit that acquires a parameter (for example, a parameter that affect the image density) relating to the image forming apparatus. The CPU 208 and the estimation unit 404 function as an estimation unit that estimates a plurality of different image densities on the basis of the parameter acquired by the acquisition unit. The CPU 208 and the estimation unit 404 may estimate a plurality of different image densities, which are densities corresponding to tone levels identified by the specifying information transmitted from the first control unit, on the basis of the parameter acquired by the acquisition unit. The estimation unit 404 may transmit the estimated plurality of image densities to the first control unit (video controller 202). In this manner, the required densities are efficiently acquired by the image forming apparatus provided with a plurality of control units.

Perspectives 2 to 4

The second control unit (for example, the engine controller 203) may identify the density of a plurality of images which are estimation targets on the basis of the tone levels transmitted from the first control unit. The specifying information may include the tone levels. The estimation unit 404 estimates densities corresponding to the tone levels included in the specifying information. The second control unit (for example, the engine controller 203) may identify the density of a plurality of images which are estimation targets on the basis of the identification information (for example, tone level numbers) of the tone levels transmitted from the first control unit. In other words, the specifying information may include identification information of the tone levels. The estimation unit 404 estimates a density corresponding to the tone level identified by the identification information included in the specifying information. The second control unit (for example, the engine controller 203) may identify the density of a plurality of images which are estimation targets on the basis of the tone levels corresponding to the densities transmitted from the first control unit and the total number of the tone levels. The specifying information may include tone levels and a total number of the tone levels. The CPU 208 may determine whether or not all tone levels required by the estimation unit have been received from the first control unit on the basis of the total number of the tone levels.

Perspectives 5, 6

The second control unit (for example, the engine controller 203) may identify the density of a plurality of images which are estimation targets on the basis of the information transmitted from the first control unit (the video controller 202). For example, the density of a plurality of images which are estimation targets may be identified on the basis of a first tone level (for example, a start value), a second tone level (for example, an end value), and a coefficient (for example, a tone level interval). In other words, the second control unit (for example, the CPU 208) may identify a plurality of tone levels on the basis of the first tone level, the second tone level, and the coefficient. Here, the coefficient is used in calculation for identifying a tone level present from the first tone level to the second tone level. For example, the coefficient may be an interval between two adjacent tone levels relating to three or more tone levels required by the estimation unit 404. Alternatively, the coefficient may be the total number N of tone levels specifying the density of a plurality of images which are estimation target. In this case, the CPU 208 calculates the tone level interval by dividing the difference between the end value and the start value by N−1. In this manner, the remaining tone levels can be identified.

Perspectives 8 and 9

As described in Example 2, the memory 209 functions as a storage unit that stores a plurality of tone level sets each including tone levels specifying the density of images which are estimation targets. The memory 209 may function as a storage unit that stores a plurality of tone level sets that each include a plurality of tone levels. The second control unit may identify the density of a plurality of images which are estimation targets on the basis of a tone level set specified by the first control unit from among the plurality of tone level sets stored in the first storage unit. In other words, the second control unit may identify a plurality of tone levels required by the estimation unit on the basis of a tone level set specified by the specifying information from among the plurality of tone level sets stored in the first storage unit. The tone level set may be specified by identification information (for example, type information) for identifying the type of the first control unit, for example. Note that the tone level set may be specified by a control mode applied to an image from among a plurality of control modes of the image forming apparatus 100. In this case, in the memory 209, the identification information of the control mode and the tone level set are associated with one another.

Perspectives 10 to 13

The parameter may be at least one of a detected environment (also referred to as an internal environment) of the image forming apparatus, an output value of high voltage used by the image forming apparatus, or a use amount of a component that wears in the image forming apparatus. The detected environment of the image forming apparatus includes at least one of a temperature, a relative humidity, or an absolute moisture amount. The high voltage of the image forming apparatus may be the charging voltage used for charging an image carrier. The high voltage of the image forming apparatus may be the development voltage used for developing an electrostatic latent image that the image is based on. The high voltage of the image forming apparatus may be the transfer voltage used for transferring the toner image that the image is based on to an intermediate transfer member or a recording medium. The use amount of a component that wears includes at least one of a use amount of toner (for example, the remaining amount of toner) or a use amount of an image carrier provided in the image forming apparatus (for example, the drum remaining amount).

Perspective 14

The second correction unit 319 functions as a generating unit that generates or updates density correction data (for example, the LUT 330) corresponding to a reference for the density correction processing on the basis of the plurality of image densities estimated by the estimation unit. According to Examples 1 and 2, specifying of the density required for generating or updating the density correction data can be transferred between a plurality of control units. As a result, the density correction data can be generated or updated more accurately than in the related art.

Perspective 15

The density correction data may be a lookup table (for example, the LUT 330) for converting a tone characteristic of the image signal. As described above, the LUT 330 holds the relationship between tone levels and image densities and is used in gradation correction (image density correction).

Perspectives 16 and 17

As can be understood from the first correction unit 318 and the second correction unit 319, the first correction unit 318 (for example, the video controller 202) may include an accuracy priority mode and a resource-saving mode. The accuracy priority mode is a mode in which the density correction data is updated or generated on the basis of a detection result of a test image formed on an image carrier provided in the image forming unit or the recording medium. The resource-saving mode is a mode in which the density correction data is updated or generated on the basis of an estimation result of the estimation unit without forming the test image. The resource-saving mode may be executed at a greater frequency than the accuracy priority mode. This allows for resources such as toner to be saved.

Perspective 18

As illustrated in FIG. 4, the memory 209 may function as a second storage unit that holds a correspondence relationship (for example, the estimation table 411) between a tone level, a parameter, and an image density. The estimation unit 404 may read out, from the second storage unit, an image density corresponding to the tone level identified by the specifying information and the parameter acquired by the acquisition unit.

Perspective 19

An image forming apparatus is provided which includes a first control unit that executes density correction processing on image data and generates an image signal; an image forming unit that forms an image on a recording medium on the basis of the image signal; and a second control unit that controls the image forming unit, wherein the second control unit includes an acquisition unit that acquires a parameter relating to the image forming apparatus, an estimation unit that estimates N number of image densities which have a possibility of being required by the first control unit on the basis of the parameter acquired by the acquisition unit, and a selection unit that selects M number of image densities actually required from among the N number of image densities estimated by the estimation unit.

Perspective 20

An image forming apparatus is provided which includes a first control unit that executes density correction processing on image data and generates an image signal; an image forming unit that forms an image on a recording medium on the basis of the image signal; and a second control unit that controls the image forming unit, wherein the second control unit includes an acquisition unit that acquires a parameter relating to the image forming apparatus, a transmission unit that transmits the parameter acquired by the acquisition unit to the first control unit; and the first control unit includes a reception unit that receives the parameter acquired by the acquisition unit, and an estimation unit that estimates a plurality of image densities on the basis of the parameter acquired by the reception unit.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-082598, filed May 14, 2021 which is hereby incorporated by reference herein in its entirety.

What is claimed is:

1. An image forming apparatus comprising:

a first control unit that executes density correction processing on image data and generates an image signal;

an image forming unit that forms an image on a recording medium on the basis of the image signal; and a second control unit that controls the image forming unit, wherein the first control unit includes a specifying unit that transmits specifying information relating to the density correction processing to the second control unit; and the second control unit includes an acquisition unit that acquires a parameter relating to the image forming apparatus, and an estimation unit that estimates a plurality of image densities corresponding to tone levels identified by the specifying information transmitted from the first control unit on the basis of the parameter acquired by the acquisition unit and transmits the plurality of image densities to the first control unit.

2. The image forming apparatus according to claim 1, wherein the specifying information includes the tone levels; and the estimation unit estimates densities corresponding to the tone levels included in the specifying information.

3. The image forming apparatus according to claim 2, wherein the specifying information includes identification information of the tone levels; and the estimation unit estimates a density corresponding to the tone level identified by the identification information included in the specifying information.

4. The image forming apparatus according to claim 1, wherein the specifying information includes tone levels and a total number of the tone levels; and the second control unit determines whether or not all tone levels required by the estimation unit have been received from the first control unit on the basis of the total number of the tone levels.

5. The image forming apparatus according to claim 1, wherein the specifying information includes a first tone level, a second tone level, and a coefficient used in calculation for identifying a tone level present from the first tone level to the second tone level; and the second control unit identifies a plurality of tone levels on the basis of the first tone level, the second tone level, and the coefficient.

6. The image forming apparatus according to claim 5, wherein the coefficient is an interval between two adjacent tone levels relating to three or more tone levels required by the estimation unit.

7. The image forming apparatus according to claim 6, wherein the coefficient is a total number of the tone levels.

8. The image forming apparatus according to claim 1, wherein the second control unit further includes a first storage unit that stores a plurality of tone level sets that each include a plurality of tone levels; and the second control unit identifies a plurality of tone levels required by the estimation unit on the basis of a tone level set specified by the specifying information from among the plurality of tone level sets stored in the first storage unit.

9. The image forming apparatus according to claim 8, wherein the tone level set is specified by identification information that identifies a type of the first control unit or is specified by a control mode applied to the image from among a plurality of control modes of the image forming apparatus.

10. The image forming apparatus according to claim 1, wherein the parameter is at least one of a detected environment of the image forming apparatus, an output value of high voltage used by the image forming apparatus, or a use amount of a component that wears in the image forming apparatus.

11. The image forming apparatus according to claim 10, wherein the detected environment of the image forming apparatus includes at least one of a temperature, a relative humidity, or an absolute moisture amount.

12. The image forming apparatus according to claim 10, wherein the high voltage of the image forming apparatus includes at least one of a charging voltage used for charging an image carrier, a development voltage used for developing an electrostatic latent image that the image is based on, or a transfer voltage used for transferring a toner that image the image is based on to an intermediate transfer member or the recording medium.

13. The image forming apparatus according to claim 10, wherein the use amount of a component that wears includes at least one of a use amount of toner or a use amount of an image carrier provided in the image forming apparatus.

14. The image forming apparatus according to claim 1, wherein the first control unit includes a generating unit that generates or updates density correction data corresponding to a reference for the density correction processing on the basis of the plurality of image densities estimated by the estimation unit.

15. The image forming apparatus according to claim 14, wherein the density correction data is a lookup table for converting a tone characteristic of the image signal.

16. The image forming apparatus according to claim 14, wherein the first control unit includes a first mode in which the density correction data is updated or generated on the basis of a detection result of a test image formed on an image carrier provided in the image forming unit or the recording medium, and a second mode in which the density correction data is updated or generated on the basis of an estimation result of the estimation unit without forming the test image.

17. The image forming apparatus according to claim 16, wherein the second mode is executed at a greater frequency than the first mode.

18. The image forming apparatus according to claim 1, further comprising a second storage unit that holds a correspondence relationship between a tone level, a parameter, and an image density;

wherein the estimation unit reads out, from the second storage unit, an image density corresponding to the tone level identified by the specifying information and the parameter acquired by the acquisition unit.

19. An image forming apparatus comprising:

a first control unit that executes density correction processing on image data and generates an image signal;

an image forming unit that forms an image on a recording medium on the basis of the image signal; and a second control unit that controls the image forming unit, wherein the second control unit includes an acquisition unit that acquires a parameter relating to the image forming apparatus, an estimation unit that estimates N number of image densities which have a possibility of being required by the first control unit on the basis of the parameter acquired by the acquisition unit, and a selection unit that selects M number of image densities actually required from among the N number of image densities estimated by the estimation unit.

20. An image forming apparatus comprising:

a first control unit that executes density correction processing on image data and generates an image signal;

an image forming unit that forms an image on a recording medium on the basis of the image signal; and a second control unit that controls the image forming unit, wherein the second control unit includes an acquisition unit that acquires a parameter relating to the image forming apparatus, a transmission unit that transmits the parameter acquired by the acquisition unit to the first control unit; and the first control unit includes a reception unit that receives the parameter acquired by the acquisition unit, and an estimation unit that estimates a plurality of image densities on the basis of the parameter acquired by the reception unit.

* * * * *